United States Patent [19]

Derr et al.

[11] Patent Number: 4,483,579

[45] Date of Patent: Nov. 20, 1984

[54] ELECTRICAL CONNECTOR HAVING IMPROVED COUPLING RING

[75] Inventors: Paul B. Derr, Middletown; Clarence L. Paullus, Lewisberry; Howard R. Shaffer, Millersburg, all of Pa.

[73] Assignee: AMP Incorporated, Harrisburg, Pa.

[21] Appl. No.: 569,938

[22] Filed: Jan. 12, 1984

Related U.S. Application Data

[63] Continuation of Ser. No. 480,040, Mar. 29, 1983, abandoned, which is a continuation of Ser. No. 243,224, Mar. 12, 1981, abandoned.

[51] Int. Cl.[3] ..... H01R 13/625

[52] U.S. Cl. ..... 339/90 R; 339/143 R

[58] Field of Search ..... 339/89 R, 89 M, 89 C, 339/90 R, 90 C, 103 C, 103 M, 143 R, 147 R, 147 P

[56] References Cited

U.S. PATENT DOCUMENTS

| | | | |
|---|---|---|---|
| 2,662,219 | 12/1953 | Hennessey, Jr. et al. | 339/103 C |
| 3,221,292 | 11/1965 | Swanson et al. | 339/217 S |
| 3,243,756 | 3/1966 | Ruete et al. | 339/143 R |
| 3,576,517 | 4/1971 | Johnson et al. | 339/94 |
| 3,588,783 | 6/1971 | Newman | 339/89 M |
| 3,831,133 | 8/1974 | Grundfest | 339/186 M |
| 3,840,839 | 10/1974 | Smaczny et al. | 339/49 R |
| 3,892,458 | 7/1975 | Clark | 339/90 R |
| 4,239,325 | 12/1980 | Tyson | 339/89 M |
| 4,305,180 | 12/1981 | Schwartz | 339/90 R |

FOREIGN PATENT DOCUMENTS

| | | | |
|---|---|---|---|
| 674001 | 4/1966 | Belgium | 339/89 R |
| 2358759 | 2/1978 | France . | |

*Primary Examiner*—John McQuade

*Attorney, Agent, or Firm*—Adrian J. LaRue; F. W. Raring

[57] ABSTRACT

An electrical connector part is disclosed of the type comprising a cylindrical housing having contact terminals therein which are mated with complementary terminals in a complementary connector part when the two parts are coupled. A cylindrical coupling ring is rotatably mounted on the housing and has on its internal surface coupling means, such as helical slots, for cooperation with a pin on the complementary connector part. The coupling ring is a composite member comprising an outer metallic cylindrical portion and a relatively thick inner metallic cylindrical portion adjacent to the leading edge of the coupling ring. The slots are provided in the inner cylindrical portion of the coupling ring and are produced by stamping slots in a flat blank, forming the blank into a cylindrical shape, and then assembling it to the outer cylindrical portion of the coupling ring. The invention eliminates the need for a separate metallic shell in surrounding relationship to the housing.

5 Claims, 4 Drawing Figures

ELECTRICAL CONNECTOR HAVING IMPROVED COUPLING RING

This is a continuation application of U.S. patent application Ser. No. 480,040 filed Mar. 29, 1983, now abandoned which is a continuation application of U.S. patent application Ser. No. 243,224 filed Mar. 12, 1981 now abandoned.

FIELD OF THE INVENTION

This invention relates to electrical connectors of the type commonly referred to as circular connectors having a cylindrical housing and having a coupling ring thereon for coupling one connector part to a complementary connector part.

BACKGROUND OF THE INVENTION

U.S. Pat. Nos. 3,576,517 and 3,892,458 disclose typical circular electrical connectors of the general type comprising an insulating housing, a metallic shell in surrounding relationship to the housing, and a coupling ring rotatably mounted on the cylindrical shell of one of the connector parts. The coupling ring has screw threads or slots on its internal surface for cooperation with screw threads, or a bayonet type pin on the surface of the shell of the complementary connector part so that when the two connector parts are mated, rotation of the coupling ring will serve to draw the two parts into engagement with each other. The coupling ring further serves to maintain the connector parts in mated relationship and prevent unmating as a result of vibration or other factors.

Electrical connector assemblies of the type shown in the above identified U.S. patents are widely used under circumstances where an extremely high quality and highly reliable connector is required, for example, in aircraft for connections in critical circuits. Connectors of this type are extremely costly as the result of the extremely high manufacturing costs. The metallic shell for connectors of the type disclosed in the above patents and the coupling rings are, for example, produced by impact extrusion, machining, and investment casting processes, all of which are extremely expensive manufacturing methods.

It would be desirable to produce high performance circular electrical connectors at a greatly reduced manufacturing cost, however, it has not been deemed practical heretofor to substitute low cost materials for the materials presently being used in circular connectors, nor has it been deemed practical to resort to manufacturing methods which are less costly than the manufacturing and processing methods currently used to produce circular electrical connector parts. The reluctance to attempt to use alternative and lower cost manufacturing methods probably stems from the rigid requirements and performance characteristics demanded for connectors used in critical circuits. The coupling ring, for example, is an essential element of a high quality electrical connector and represents a substantial portion of the manufacturing cost of the completed connector. The coupling ring must be of a relatively thick metal and must be capable of withstanding abusive and careless treatment without interference with its function. For this reason, the coupling rings of presently available circular connectors are produced by combination of impact extrusion and machining operations, which are inherently high cost operations. The metallic shell likewise is a relatively expensive element and is produced by time consuming machining operations.

The present invention is then directed to the achievement of a circular electrical connector which can be produced at a greatly reduced cost. The objectives of the invention are achieved in part by eliminating the need for a separate metallic shell on one of the connector parts and having the coupling ring serve as the shielding function of the shell of prior art connectors as well as the coupling function. The coupling ring is produced as a composite member comprising an outer metallic cylindrical portion and an inner metallic cylindrical portion, concentrically mounted in the outer portion at the leading, or mating, end of the outer portion. The outer portion can be produced by drawing and is dimensioned such that it will overlap the cable clamp which is affixed to the rearward end of the connector housing, thereby providing shielding along the entire length of the connector part. The bayonet slots or threads, if desired, are obtained in the inner cylindrical portion by forming the slots in a flat rectangular blank and thereafter forming the blank into a cylindrical shape. The formed blank is then fitted into the outer cylindrical portion of the coupling ring and welded or fixed in its proper position.

PREFERRED EMBODIMENT OF THE INVENTION

Figures 1, 2:
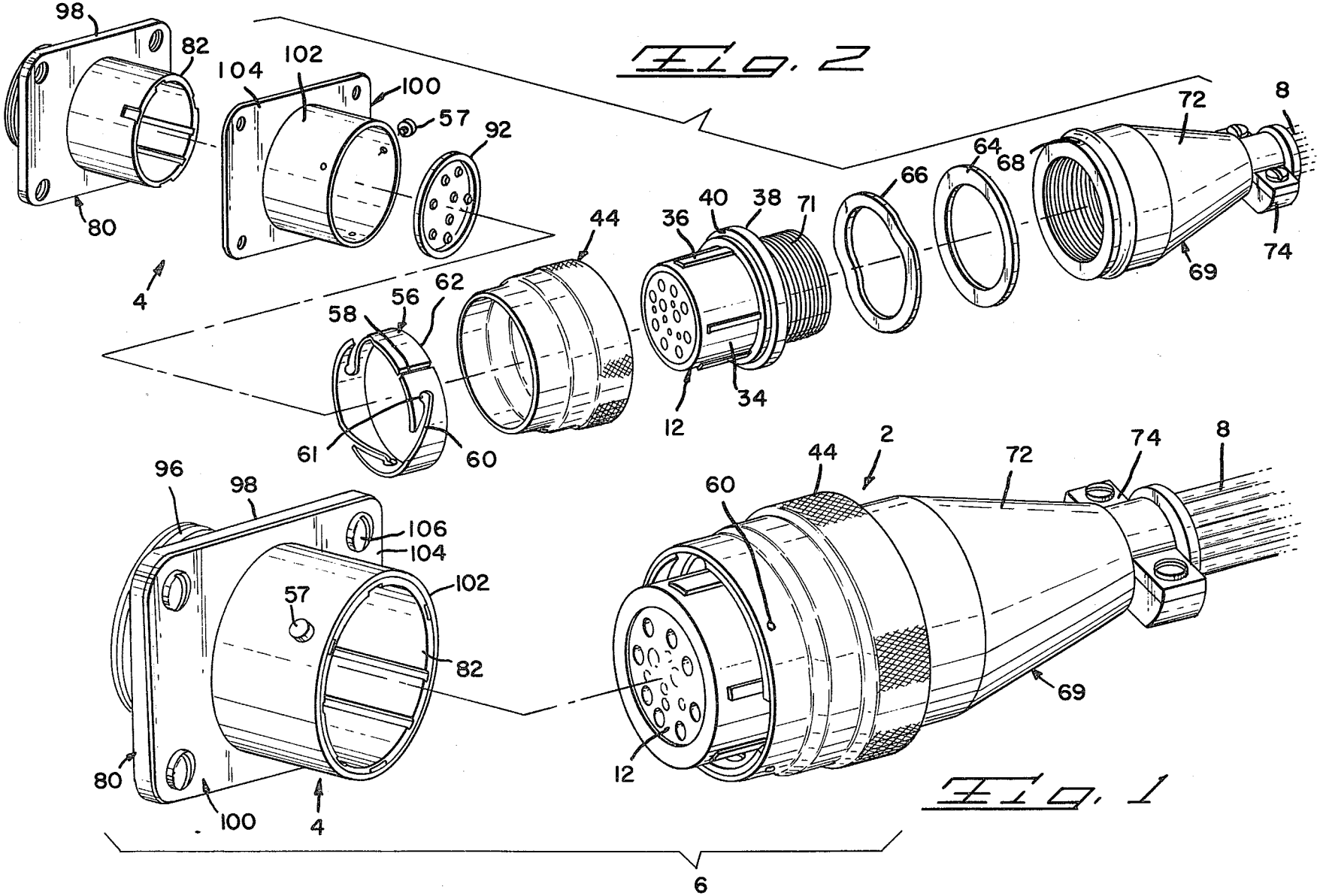
FIG. 1 is a perspective view of a connector plug part in accordance with the invention, in alignment with a complementary receptacle part.
FIG. 2 is a view similar to FIG. 1, but showing the elements of the plug and receptacle parts exploded from each other.

A connector plug part 2 in accordance with the invention, is dimensioned to be coupled to a receptacle part 4 to form an electrical connector assembly 6. The connector assembly serves to disengageably connect wires 8 which extend to terminals in the plug part 2 to conductors 10 which extend to terminals in the receptacle part.

The plug part 2 comprises a housing assembly 12 of insulating material having a mating face 14, a wire entry face 16, and one or more cavities 18 extending therethrough. A contact terminal 20 is mounted in each cavity, the disclosed embodiment having contact sockets in the plug part 2 which receive contact pins 21 mounted in the receptacle.

The housing assembly comprises a main housing body 22 having a rearwardly extending skirt or flange 32 within which are mounted suitable cylindrical inserts 24, 26. The portions of the cavities which extend through the inserts 24 are somewhat enlarged for the reception of a spring retainer 28 which engages a shoulder 30 on the contact terminal to retain the terminal in the housing. The insert 26 of the disclosed embodiment is of a relatively resilient material, thereby to provide a seal around each of the wires 8, as shown. The main housing body 22 and the inserts 24, 26 may be of suitable plastic materials which are commonly used in circular connectors.

The cylindrical surface 34 of the main housing body has axially extending keys 36 thereon adjacent to the mating face 14 for reception in complementary keyways 35 in the housing hood 82 of the receptacle part. A circumferential rib 38 is provided on the surface 34 between the oppositely directed faces 14, 16 and this rib is stepped on its lefthand side, as viewed in FIG. 3, to provide a forwardly facing shoulder 40. The rib also provides a rearwardly facing shoulder 42 for cooperation with a spring washer 66, as described below.

The coupling ring 44, which also provides shielding for the housing assembly, comprises an outer cylindrical member 45 having a leading edge 46 and a trailing edge 48. The coupling ring is advantageously produced by a drawing operation and has in the disclosed embodiment a relatively thin wall, as shown. The external surface of the outer cylindrical portion 45 has a somewhat smaller diameter forward portion 50, intermediate portion 52, and a rearward portion 54 which extends to the trailing edge 48. These three portions are stepped very slightly, as shown in FIG. 3, and the internal diameter of the outer portion 45 is similarly stepped, as shown.

The coupling means on the coupling ring comprises a separate inner cylindrical member 56 formed from a flat plate so that it has an axial seam, as shown at 58. A plurality of helically extending slots 60 extend from the lefthand edge of the inner cylindrical member 56 for the reception of pins 57 on the external surface of the receptacle part 4. The slots 60 have inner ends 61 which receive the pin when the parts are fully coupled and which form pockets that discourage accidental disengagement of the two parts of the connector assembly.

Figure 3:
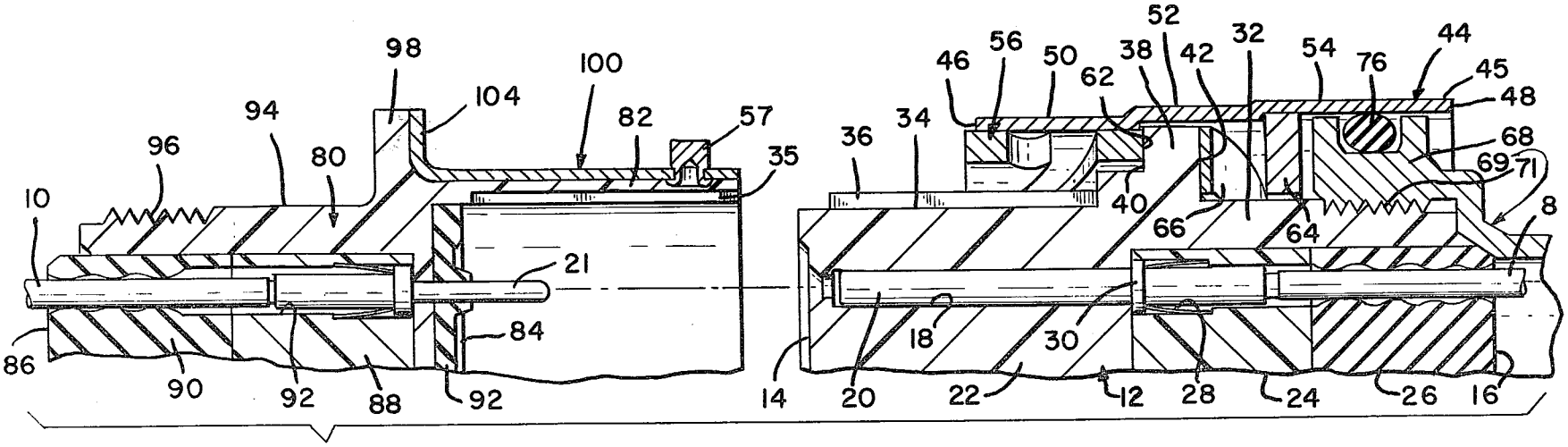
FIG. 3 is a fragmentary cross-sectional view of a plug part and a receptacle part in alignment with each other.

The rightwardly facing side edge 62 of the inner cylindrical member 56 is disposed against the leftwardly facing shoulder 40 on the rib 38 of the housing 12, thereby preventing rightward movement of the coupling ring from the position shown in FIG. 3, while permitting rotation of the ring relative to the housing. The coupling ring is also maintained on the housing by means of a locking ring or retaining ring 64, which secured as by welding to the internal surface of the rearward portion 54 of the drawn cylindrical member 45. An undulating spring washer 66 is interposed between the rightwardly facing shoulder 42 of the rib 38 and the leftwardly facing surface of the ring 64 so that the coupling ring is resiliently biased rightwardly relative to the housing, as viewed in FIG. 3.

The cable clamp 69 comprises a metallic member which again may be produced by drawing, having a cylindrical portion 68 which is internally threaded for cooperation with the threads 71 on the surface of the housing skirt 32. The portion 68 thus surrounds the housing proximate to the wire entry face 16, overlaps the righthand portion 54 of the outer cylindrical part of the coupling ring. The cylindrical portion 68 of the cable clamp merges with a conical portion 72 that extends to a suitable clamping yoke 74 which surrounds the bundle of wires 8. It is desirable to provide a circumferential groove in the cylindrical portion 68 of the cable clamp and to mount a sealing O-ring 76 in this groove. This sealing ring may be of a conductive elastomeric material to ensure electrical contact between the outer cylindrical portion of the coupling ring and the cable clamp and thereby ensure effective shielding of the entire housing assembly of the connector part.

The receptacle part 4 of the connector assembly comprises a shell 100 and an insulating housing assembly 80 having a forwardly extending hood 82 which receives portions of the housing member 22 of the plug. The mating face 84 of the receptacle may be provided with a sealing member, as shown at 92, thereby to achieve an interface seal in the connector parts when they are assembled.

The external cylindrical surface 94 of the housing 80 has threads 96 for cooperation with a cable clamp, if desired. The housing member also has contained therein an insert 88 and a sealing insert 90, as previously described and shown in the plug member at 24 and 26.

A mounting flange 98 is provided on the external surface of the housing 80 and the shell 100 has a complementary flange 104 which is disposed against the surface of the housing flange. The two flanges may be secured to each other by any suitable means and in addition, screws 106 are provided to mount the plug part in a panel or the like. The forward cylindrical portion 102 of the receptacle shell 100 extends over the external surface of the hood 82 of the housing and previously identified pins 57 are mounted in this forward portion of the shell for cooperation with the slots 66 in the coupling ring.

It will be apparent that when the plugs and receptacle are coupled to each other, there will be continuous metallic shielding in surrounding relationship to the two connector parts from a point beginning at the cable clamp 69 to the flange 98 of the receptacle. The embodiment shown is intended for mounting in a panel and it is usually not necessary to provide shielding on the lefthand portion 94 of the housing 80. However, such shielding can be provided for a free hanging connector assembly (which is not intended for mounting in a panel) by simply providing a shield on the receptacle which would extend to the wire entry face of the receptacle housing.

Figure 4:
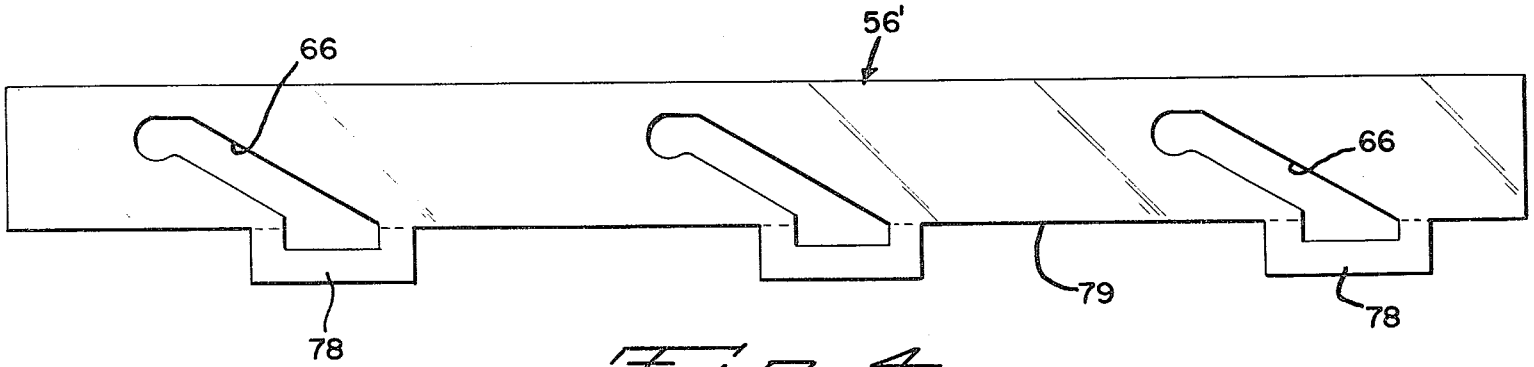
FIG. 4 is a plan view of a flat blank from which the inner cylindrical portion of the coupling ring is formed.

FIG. 4 shows a flat blank 56′ from which the internal cylindrical portion 56 of the coupling ring is produced. The slots 66 are formed in the blank by stamping and can therefore be precisely dimensioned. However, it is desirable to provide integral retaining portions 78 at the mouths of the slots. These integral retaining portions are simply U-shaped extensions of the edge 79 of the blank. The blank 56′ is formed into a cylindrical shape and fitted into the forward portion 50 of the outer cylindrical portion of the coupling ring prior to removal of these retaining portions 78 so that the dimensions of the slots will be maintained. After the formed blank 56′ is fitted into and secured to the drawn shell, the retaining portions 78 are removed in a relatively simple machining operation.

It will be apparent from the foregoing description that a connector plug in accordance with the invention, has all of the initial features of a conventional circular electrical connector and that the parts, if properly designed and made of suitable materials, will have all of the advantages of the connector plug which are realized with prior art connectors. The manufacture expense of the connector plug is, however, substantially reduced when compared with prior art manufacturing methods.

What is claimed is:

1. An electrical connector, comprising:

a dielectric housing member having a mating surface and a wire entry surface, passageway means extending through the housing member, electrical terminal means secured in said passageway means for matable electrical connection with electrical contact means in a complementary electrical connector;

a metal shell member extending along said housing member from a position adjacent said mating surface to another position adjacent said wire entry surface, said metal shell member engaging a part of said housing member and being rotatable relative to said housing member;

coupling means as part of said metal shell member for coupling engagement with complementary coupling means on the complementary electrical connector to couple the electrical connector and complementary electrical connector together enabling the electrical terminal means to be electrically connected to the electrical contact means;

means on said metal shell member on one side of said part of said housing member and said coupling means on another side of said part mounting said metal shell member on said housing member for rotation relative to said housing member; and a metallic cylindrical mounting section mounted on said housing member surrounding said wire entry surface, said metal shell member and said cylindrical mounting section have overlapping portions whereby said metal shell member and said cylindrical mounting section define shield means for said connector.

2. An electrical connector as set forth in claim 1 wherein said coupling means comprises slot means extending helically with respect to the axis of said metal shell member from a front circumferential edge, said slot means being dimensioned to receive complementary pin means fixed to the complementary connector.

3. An electrical connector as set forth in claim 1 wherein resilient conductive sealing means is disposed between said overlapping portions.

4. An electrical connector as set forth in claim 1 wherein said mounting means includes spring means enabling said metal shell member to move axially relative to said housing means.

5. An electrical connector as set forth in claim 1 wherein said metallic cylindrical mounting section has cable clamp means for clamping onto cable means extending therethrough.

* * * * *